US009230730B2

(12) United States Patent
Heins

(10) Patent No.: US 9,230,730 B2
(45) Date of Patent: Jan. 5, 2016

(54) BI-TOROIDAL TOPOLOGY TRANSFORMER

(71) Applicant: Thane C. Heins, Almonte (CA)

(72) Inventor: Thane C. Heins, Almonte (CA)

( * ) Notice: Subject to any disclaimer, the term of this patent is extended or adjusted under 35 U.S.C. 154(b) by 0 days.

(21) Appl. No.: 14/199,541

(22) Filed: Mar. 6, 2014

(65) Prior Publication Data

US 2014/0253271 A1 Sep. 11, 2014

Related U.S. Application Data

(60) Provisional application No. 61/773,877, filed on Mar. 7, 2013.

(51) Int. Cl.
*H01F 27/00* (2006.01)
*H01F 30/04* (2006.01)

(52) U.S. Cl.
CPC ..... *H01F 30/04* (2013.01); *H01F 27/00* (2013.01)

(58) Field of Classification Search
CPC ..... H01F 27/00–27/30
USPC ..... 336/212, 225, 229, 214–215
See application file for complete search history.

(56) References Cited

U.S. PATENT DOCUMENTS 4,158,156 A * 6/1979 Knoll ..... 315/278

FOREIGN PATENT DOCUMENTS

CA 2594905 A1 * 1/2009

* cited by examiner

*Primary Examiner* — Tuyen Nguyen
(74) *Attorney, Agent, or Firm* — Leslie R. J. Virany

(57) ABSTRACT

The present invention relates to electrical transformers and, in particular, to improvements to efficiency in energy conversion in electrical transformers. The improved transformer has a bi-toroidal circuit topology in which the magnetic flux passing through the primary and secondary coils are different. The turns ratio displays an "effective magnification" like an impedance transformed by a feedback loop. The result is a transformer which displays virtually no primary input current increase from no-load to on-load and an on-load power factor of zero for a purely resistive load.

15 Claims, 16 Drawing Sheets

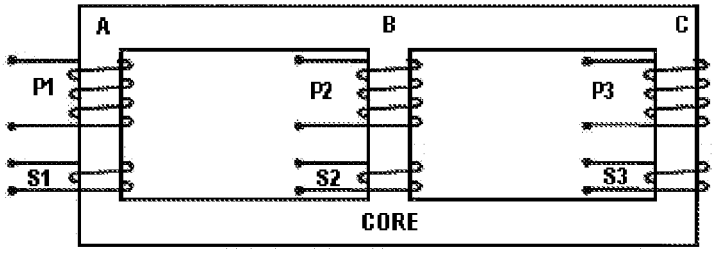
Fig. 1A
*PRIOR ART*
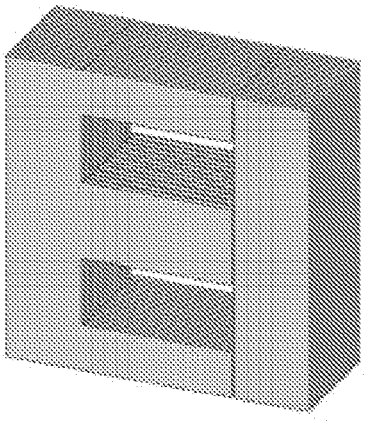
Fig. 1B
*PRIOR ART*
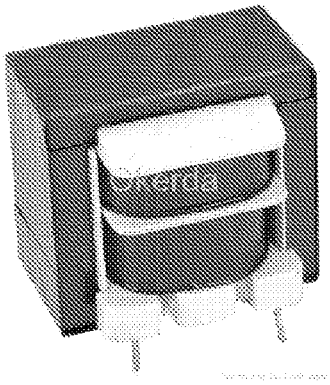
Fig. 1C *PRIOR ART*

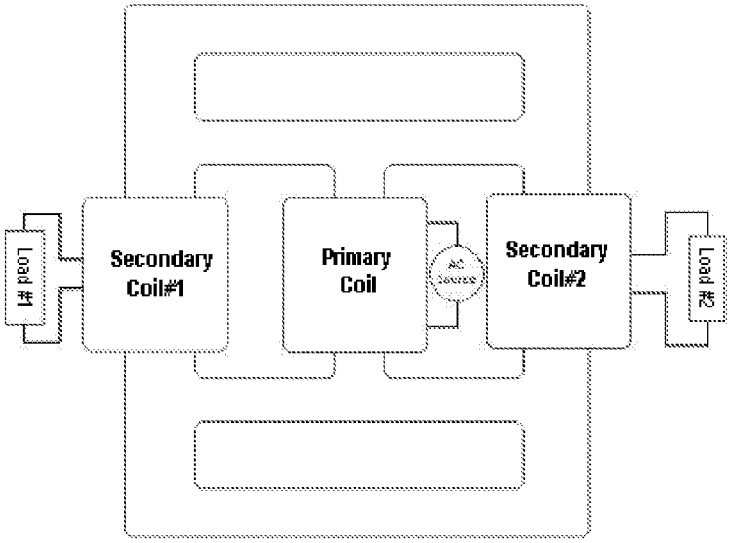
Fig 2A
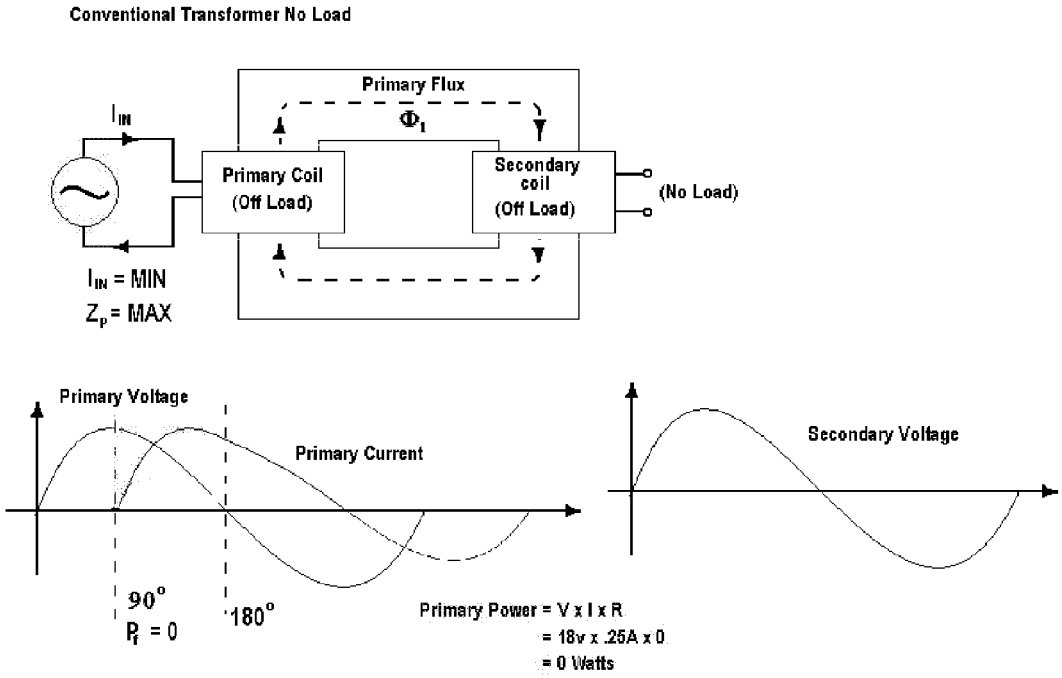
Fig 11 *PRIOR ART*

Fig. 8
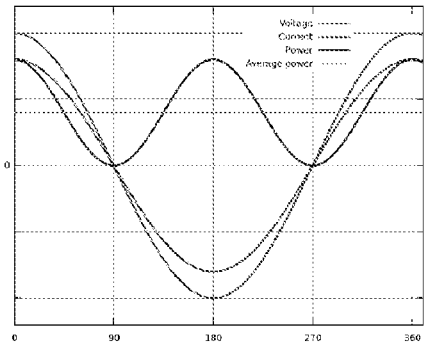
Fig. 9 *PRIOR ART*
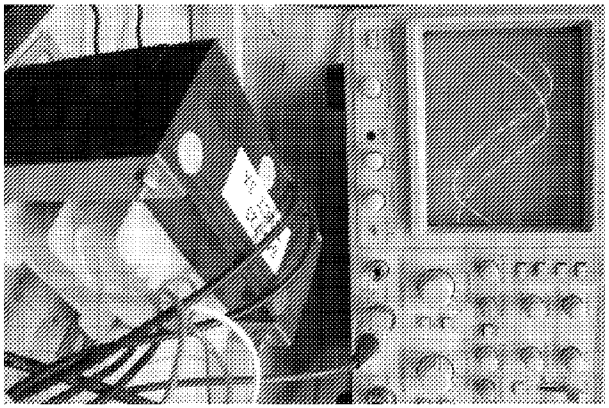

Fig 10 *PRIOR ART*
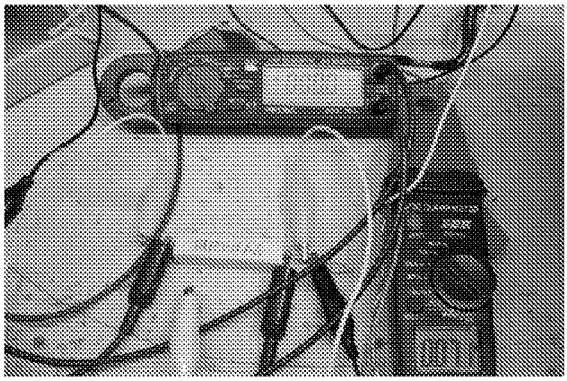
Fig 12
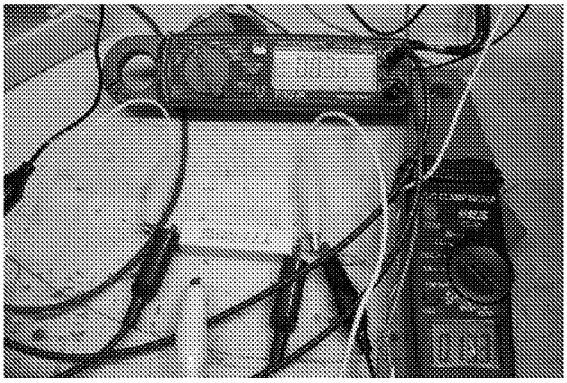

Fig. 13 *PRIOR ART*
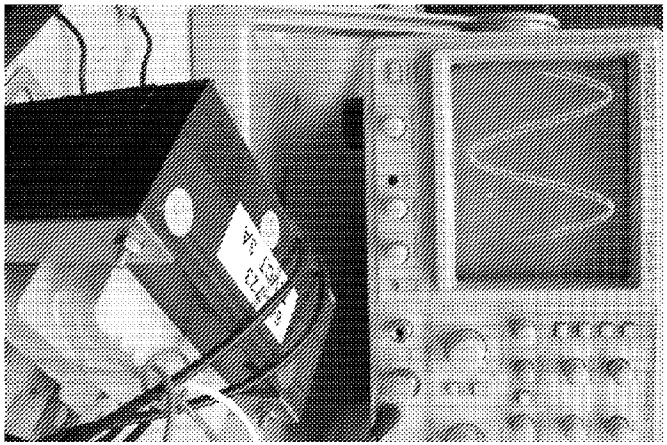
Fig. 15
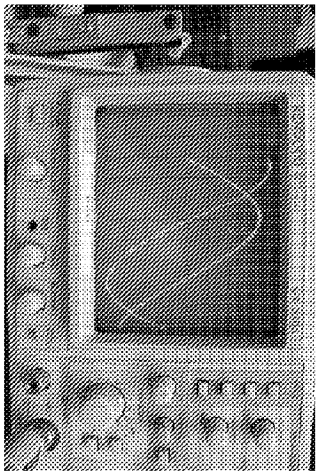

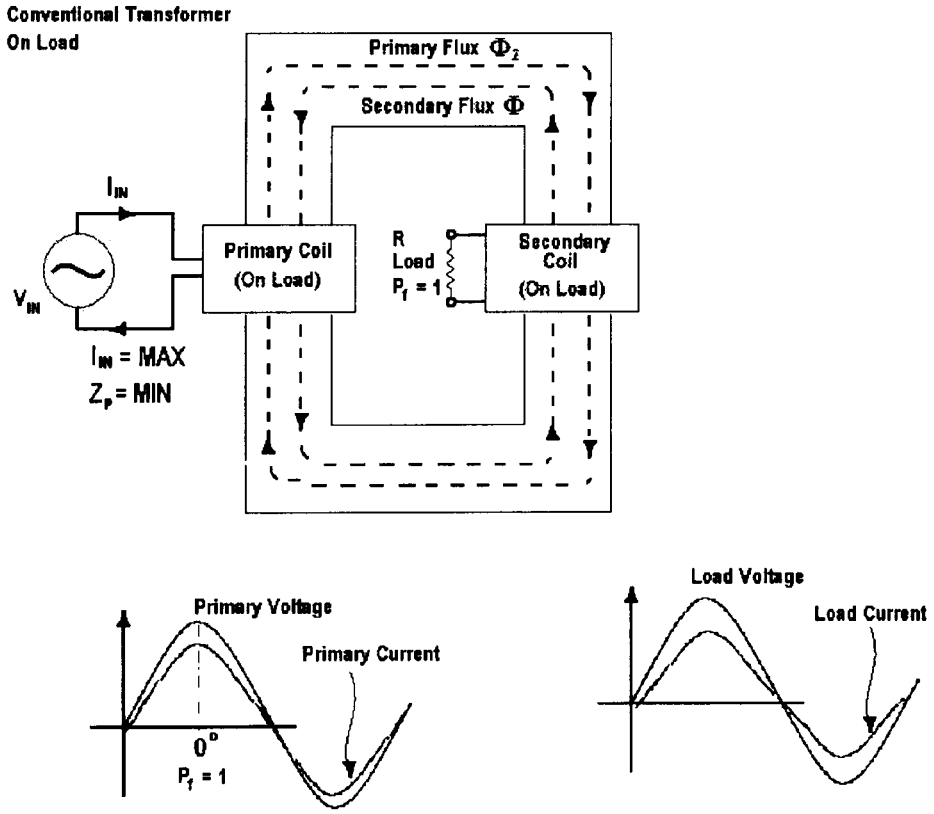
Fig. 14A *PRIOR ART*
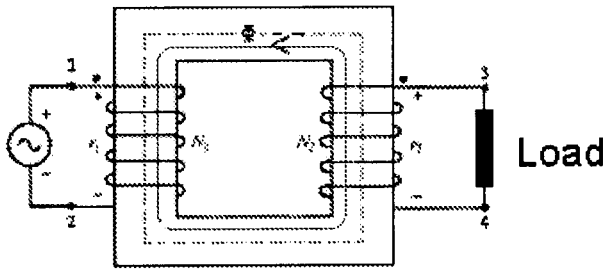
Fig. 14B *PRIOR ART*

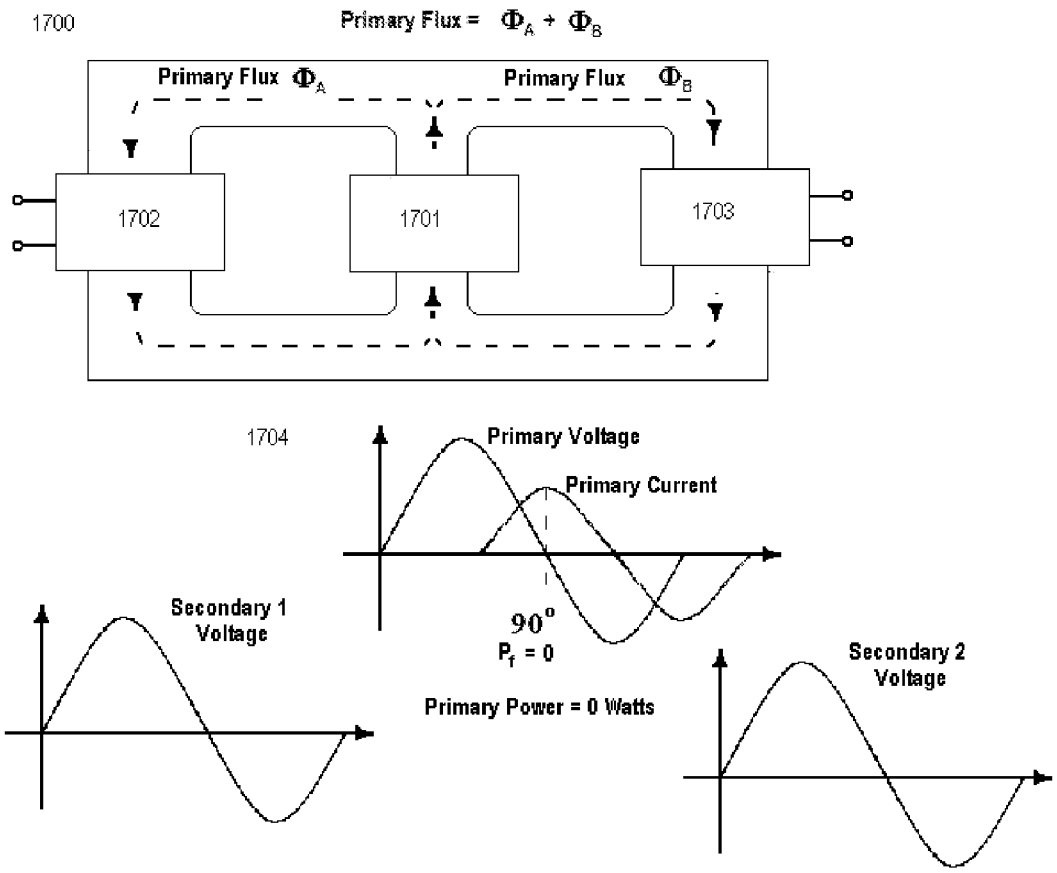
Fig 17. No-Load Flux Diagram for Bi-Toroid Transformer

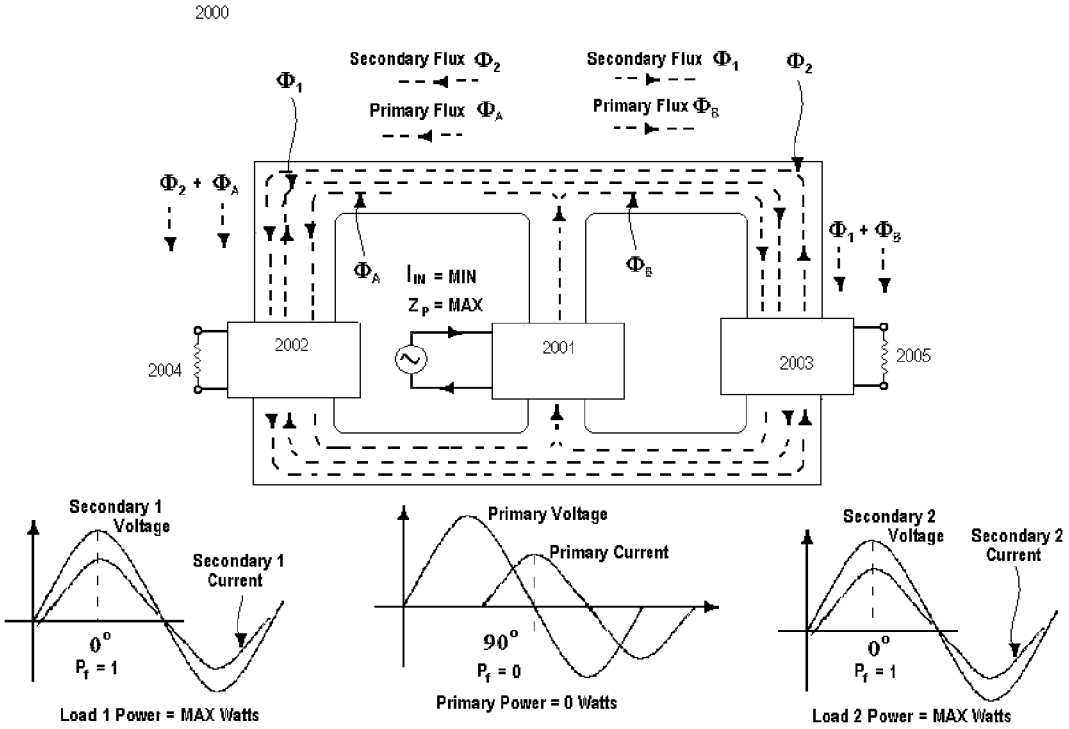
Fig. 20 On-Load Secondary Induced Flux Return Path in the BiTT

Fig. 21

Demo Test # 4
Bi-Toroid vs. Conventional Transformer

Primary Coil Current and Power Factor Comparison

| | Conventional Transformer NO Load | Conventional Transformer ON Load | Bi-Toroid Transformer NO Load | Bi-Toroid Transformer ON Load |
|---|---|---|---|---|
| Current mA | 71 | 139 | 130 | 130 |
| Power Factor | 0 | 1 | 0 | 0 |

Fig. 22

Demo Test # 4
Bi-Toroid vs. Conventional Transformer

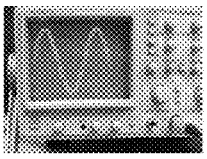

ON LOAD
Conventional Transformer

Power Factor = 1

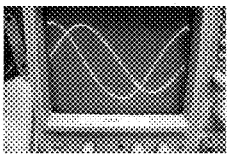

NO LOAD
Bi-Toroid Transformer

Power Factor = 0

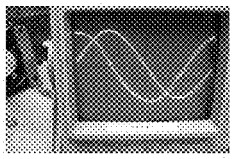

ON LOAD
Bi-Toroid Transformer

Power Factor = 0

BI-TOROIDAL TOPOLOGY TRANSFORMER

Copending application Ser. No. 14/059,775 is herein incorporated by reference in its entirety for essential subject matter.

BACKGROUND OF THE INVENTION

In a transformer, the instantaneous voltage induced across the secondary coil is given from Faraday's Law by:

$$V_s = N_s d\Phi/dt$$

where Ns is the number of turns in the coil and Φ is the magnetic flux. (integral of magnetic field over the cross-sectional area of the coil) If the coil axis is perpendicular to the magnetic field lines, (normally the case by choice in transformers) total flux reduces to a product of the flux density B and the (constant) area A through which it cuts. B varies with time according to the excitation of the primary. By Gauss's law for magnetism the same magnetic flux passes through both the primary and secondary coils so in an ideal transformer the instantaneous voltage across the primary winding is:

$$V_p = N_p d\Phi/dt$$

Therefore the voltages, turns ratios and currents in the two coils can be related by:

$$V_s/V_p = N_s/N_p = I_p/I_s$$

Many applications of prior art transformers follow these equations, as illustrated in FIG. 1.

SUMMARY OF THE INVENTION

The transformer of the present invention, sometimes referred to herein as 'Bi-Toroid Transformer' or "BiTT" does not behave according to the transformer equation as given above and thus overcomes the problems with the prior art. The BiTT's circuit topology has been changed so that it is no longer true that the same magnetic flux passes through both the primary and secondary coils. The turns ratio displays an "effective magnification" like an impedance transformed by a feedback loop. The result is a transformer which displays virtually no primary input current increase from no-load to on-load and an on-load power factor of zero with as long as it has a purely resistive load.

As will be described in greater detail below, under such conditions, as compared with the prior art, the BiTT consumes mostly reactive power in the primary while delivering real power to the loads. Such a transformer could be used in a wide variety of applications and especially, owing to its increased efficiency and therefore reduced production of heat, could be installed for the distribution of AC electrical power throughout the residential and industrial grid having reduced cooling systems including fluids containing harmful chemicals.

DESCRIPTION OF DRAWINGS

FIGS. 1A, B & C shows Prior Art—a three-phase transformer, in which the ideal transformer equations can be applied relatively straightforwardly.

FIGS. 2A and 2B illustrate the Bi-Toroid Transformer (BiTT) which is adapted from the topology of FIG. 1 in which the primary is placed on the central leg and two secondaries (or a 'split secondary') are wound around the two side legs.

FIG. 8 shows the various Sine waves with a Power Factor of 1 (Pf=1).

FIG. 9 shows a conventional transformer on no-load.

FIG. 10 shows the input current and the output voltage across a load for a conventional transformer when on no-load. The input current is 0.071 Amps.

FIG. 11 shows how the primary coil delivers magnetic flux to the secondary coil in a conventional transformer and how a voltage is induced in the secondary coil.

FIG. 12 shows the same transformer output when it is collected across the load the primary current increases to almost double the no-load current at 0.133 Amps.

FIG. 13 shows the on load voltage and current sine waves for the conventional transformer with a purely resistive load which has a power factor of 1.

FIG. 14A illustrates how the primary coil's magnetic flux is delivered to the secondary coil through the ferromagnetic core, in a conventional transformer.

FIG. 14B illustrates secondary to primary induced flux direction, in a conventional transformer.

FIG. 15. Shows the no-Load Bi-Toroid Transformer Voltage and Current Sine Waves FIG. 16. Shows the no-load Bi-Toroid Transformer Input and Output FIG. 17 Illustrates how the BITT, when properly tuned, behaves in which the induced flux predominates below the critical minimum frequency $\omega_c$ FIG. 18. Shows the on-Load Bi-Toroid Transformer Input and Output and how the efficiency of the transformer is highly dependent on the precise adjustment of the coupling coefficient FIG. 19 Shows the on-Load B-Toroid Transformer Voltage and Current Sine Waves FIG. 20 Shows flux compared with current in a parallel resistor circuit FIG. 21 Shows a current and power factor comparison between a BiTT and a conventional transformer FIG. 22 Shows a performance comparison between a BiTT and a conventional transformer FIG. 23 Shows on-load sine wave comparisons between a conventional transformer and a BiTT FIG. 24 Shows BiTT primary sine wave comparisons on No-Load and On-Load.

DETAILED DESCRIPTION

Physically the BiTT as shown in FIG. 2 differs from a conventional transformer in that the BiTT has a 'split secondary' coil, or two secondary coils and an alternate flux path route for secondary BEMF induced flux. The BiTT is specifically designed to keep secondary induced flux away from the primary core.

Figure 2B:
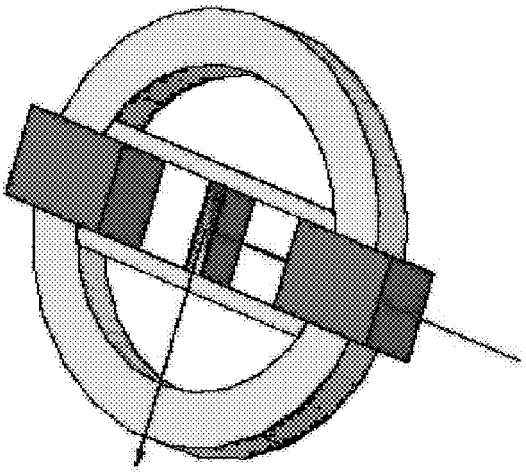

As illustrated in FIGS. 2A and 2B, the BiTT ring-shaped toroidal core provides the alternate flux path joining the two secondaries. The outer secondary flux path isolates the primary from secondary induced BEMF as described further in the text. Shown is an inner three legged transformer with outer secondary Toroid flux path route which isolates primary from secondary BEMF induced flux.

Figure 4:
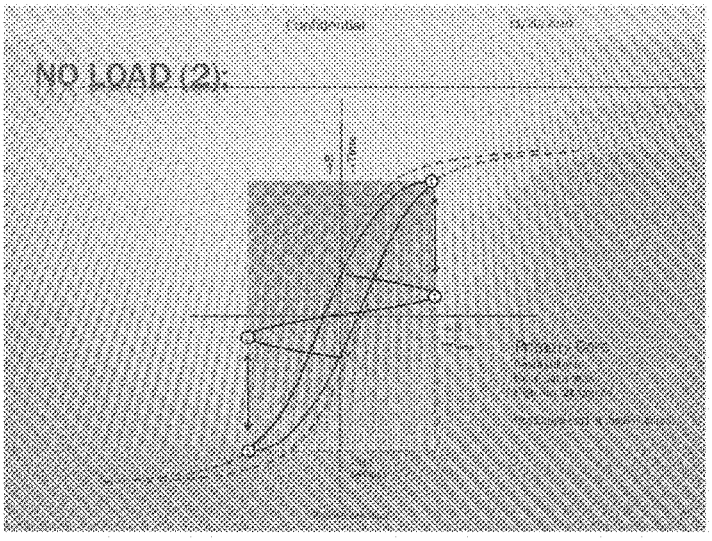
FIG. 4 shows how the cross sectional area of a ferromagnetic core plays an important role in dictating the core's reluctance and how much magnetic flux can flow at any given time.
Figure 5:
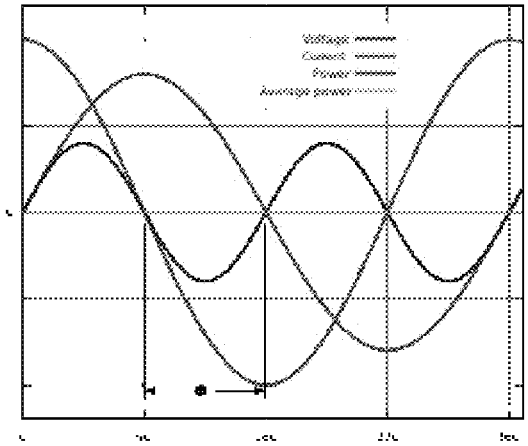
FIG. 5 shows the various sine waves with a Zero Power Factor (Pf=0).

As shown in FIG. 4 the secondaries uses a smaller region of the B-H curve (operate further from saturation). This is intentional since magnetic flux always follows the path of least reluctance and since core reluctance increases with flux magnitude, the secondary core region is designed to always be much lower than the primary core, encouraging flux to stay in the outer flux path and avoid the primary core flux path. As the flux magnitude in the core increases in tandem with primary current, so too does the core's reluctance. The core's reluctance peaks when the input current sine wave peaks (at 90 and 270 degrees) as shown in FIG. 5 and is minimum when the current passes through the zero point on the Y Axis (at 0, 180 and 360 degrees). The BiTT uses this fact in conjunction with the secondary coil current delay to help ensure that the majority of secondary induced BEMF flux does not couple back through the primary but stays in the outer toroid ring.

With reference to FIG. 5, the voltage and current sine waves are 90 degrees out of phase. The power sine wave is evenly distributed and all power is Reactive Power with zero net real power consumption.

Figure 6:
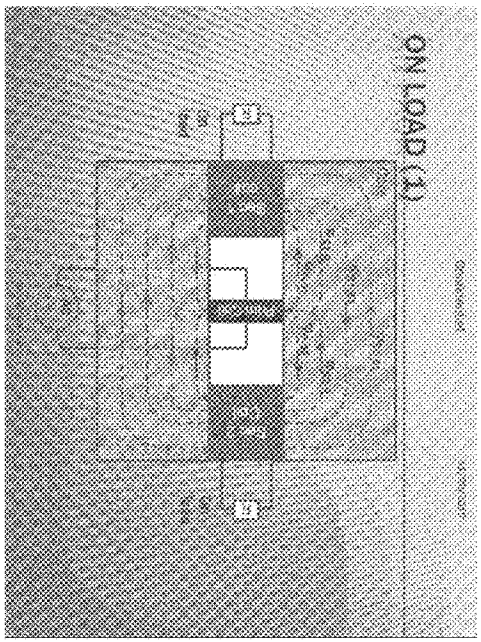
FIG. 6 shows the idealized isolated flux paths when the BiTT is placed on-load and current flows in the secondary coils.

As shown in FIG. 6 the primary uses a physically smaller core and utilizes larger region of the B-H curve (operates closer to saturation). Saturation is not completely beneficial for the BiTT, but operating near saturation keeps the primary reluctance in its optimal range. Back EMF induced magnetic flux is created according to Lenz's Law. The induced magnetic flux follows the lowest reluctance flux path from one secondary coil into the other secondary coil and avoids the higher reluctance primary core route. The secondary induced flux maintains the flux magnitudes required for the secondary coil's to deliver power to the load without requiring a primary current or power increase.

Figure 7:
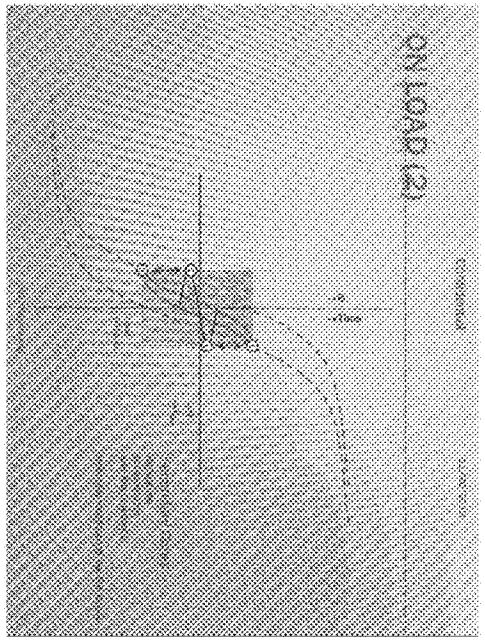
FIG. 7 shows the BiTT Secondary On-Load B-H Curve.

Referring to FIG. 7, typically in any conventional transformer design, the secondary induced on-load flux couples directly back through the primary core and it causes the primary impedance to decrease which in turn causes the primary current to increase (and primary losses to increase and overall efficiency to decrease) while the load power factor is reflected back onto the primary such that, if the load power factor is 1 the on-load power factor of the transformer primary will also be 1 as shown in FIG. 8, which shows the sine wave relationships for a transformer primary where a power factor of 1 is exhibited. A power factor of 1 denotes that the current and voltage are in phase with each other and that real power is being consumed in the transformer primary coil.

No-load power factor in an ideal coil is 0 as displayed in FIG. 5, with pure Reactive Power being consumed and no real power consumption in the coil. FIG. 8 shows the various Sine waves with a Power Factor of 1 (Pf=1). All power is Real Power with 100% power consumption.

Comparison Between Conventional Transformer Performance Vs BiTT Performance

As shown in FIG. 9, the current lags the voltage by 90 degrees. The current that flows in the primary coil when 90 degrees out of phase with the voltage is called Reactive Current. Reactive Current flows into the primary coil on one half of the sine wave and back to the source on the other half of the sine wave. The Power factor for an ideal transformer on no-load is zero and the Net power consumption is also zero.

$$P_{in}=V_{in}\times I_{in}\times \text{Power Factor}$$

Because the PF is zero the primary consumes only Reactive Power (ie zero Real Power).

FIG. 11 shows a Conventional Transformer 1100, a Primary Coil (Off Load) 1101, a Secondary Coil (Off Load) 1102 and R, Load, Pf=1 1103

FIG. 12 illustrates the case of a conventional transformer placed on on-load, with current flowing in the secondary coil to the load. This current produces induced BEMF magnetic flux which couples back through the transformer core and through the primary coil. The secondary induced flux reduces the primary coil's impedance which allows additional current to flow in the primary windings. The increased current flow in the primary coil increases the primary coil's induced flux which is delivered to the secondary coil which is required to maintain the secondary coil's flux magnitude and sustain the power to the load.

In a conventional transformer, as shown in FIG. 13, the primary and secondary coils are magnetically linked with a coupling coefficient of 1 and the load power factor dictates the secondary coil power factor which in turn dictates the primary power factor. As a comparison the BiTT secondary coils are magnetically connected to the primary on no load with a coupling coefficient of 1 but isolated from the primary on load with a coupling coefficient of 0.

Without the primary current and flux increase the secondary voltage would collapse on-load and no sustained power would be delivered by the transformer when placed on load. The primary coil's input current increase is a function of Lenz's Law and a performance requirement but it comes at a penalty with increased primary heat and a corresponding loss in energy conversion efficiency.

The BiTT design eliminates the need for a primary coil current increase when the BiTT is placed on load because the secondary coil's each provide the required on load flux magnitude increase needed to deliver sustained power to the load. This allows the BiTT primary coil to operate with the same low no load input current level same no load power factor and minimal heat, power loss and power consumption while delivering real power and operating on load.

FIG. 14A shows a conventional 3-phase Transformer 1400, Primary Coil (On Load) 1401, Secondary Coil (On Load) 1402 and R, Load, Pf=1 1403.

With reference to FIGS. 14A and B, the secondary coil is placed on load and current flows in the secondary coil which gives rise to a BEMF induced flux which couples back to the primary, causing primary current, heat and losses to increase as well as altering the primary coil's power factor.

Flux flow can be compared with current in a parallel resistor circuit as shown in FIG. 20. Reluctance behaves much like resistance, in that the induced magnetic field will follow the path of least reluctance:

−V corresponds to the secondary flux source.

R1=10Ω and corresponds to the secondary cores as seen by the primary, causes large flux flow.

R2=10 kΩ and corresponds to the primary core as seen by the secondary, causes small flux flow.

FIG. 20 shows a Bi-Toroid Transformer (On Load) 2000, Primary Coil (On Load) 2001, Secondary Coil #1 (On Load) 2002, Secondary Coil #2 (On Load) 2003, R, Load #1 2004 and R, Load #2 2005

FIG. 21 shows a Primary Coil 2101 (On Load), Secondary Coil #1 (On Load) 2102, Secondary Coil #2 (On Load) 2103, High Reluctance Flux Path 2104, Low Reluctance Flux Path 2105, R, Load #1 2106, R, Load #2 2107, High Reluctance Flux Path 2108 and Low Reluctance Flux Path 2109

Figure 3:
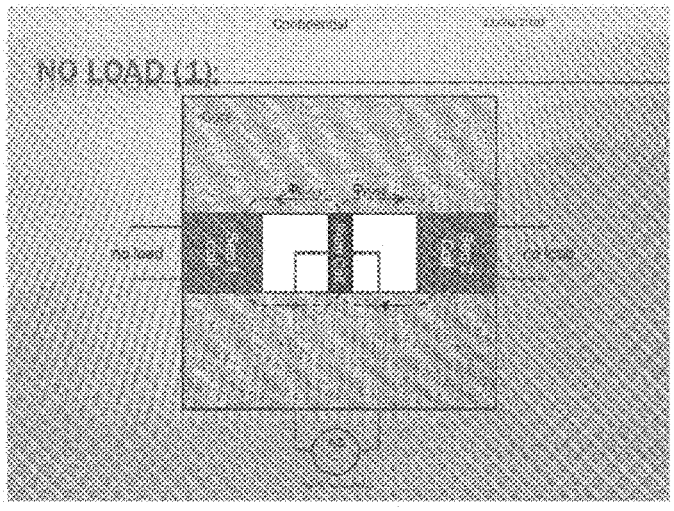
FIG. 3 shows the flux delivered by the BiTT primary is evenly distributed between the two secondary coils and no-load voltages are induced in each secondary coil according to Faraday's Law of Induction.

In the dynamic situation, the initial primary flux ϕP-S2 and ϕP-S1 create near saturation, making the primary core a high reluctance core part, as shown by the nonlinear 'hysteresis' behavior in B-H curves, (FIGS. 6 & 7). Counter flux ϕP-xx caused by the load resistors and current flow in the secondary coils are created in non-saturated core parts and have low reluctance. As illustrated (analogously) by FIG. 20, the secondary fluxes can choose between a high reluctance path or a low reluctance path and of course most of the secondary flux will travel the low reluctance path, through the secondary cores and avoid the primary flux path route altogether. [FIGS. 3, 4, 5 show flux paths]

Some remaining secondary flux will travel through the high reluctance path, through the primary core, which is the main thermodynamic limitation of the BiTT and which the inventor has succeeded in minimizing, through further steps to be described in detail below.

Bi-Toroid Transformer (BiTT) Construction

The invention was constructed by modifying a prior art three phase transformer as shown in FIG. 1 by placing the primary in the centre with the two secondaries at each side. Then an outer toroid was added which connects the two secondaries to each other but effectively bi-passes the primary. Now the primary delivers flux to both the secondaries, as shown in FIG. 5. The path of least reluctance seen from the secondaries favors the outer toroid so that secondary induced BEMF flux does not couple back to the primary as in the conventional arrangement. Instead the secondary induced flux follows the lower reluctance flux path route and couples to the other adjacent secondary while providing the flux required to induce the current that maintains the voltage across the load.

Coil Flux Couple Coefficients

The BiTT employs Mutual and Non-Mutual Coupling Coefficients in symmetric and non-symmetric ways:

Mutual Coupling:

Primary to Secondary 1*(~0.5), Primary to Secondary 2*(~0.5), Secondary 1 to secondary 2 (~1), Secondary 2 to secondary 1 (~1)

*Note: The Coupling Coefficient to the entire split-secondary assembly is actually 1 but each side of the secondary only gets ½ the Primary Flux.

Non-Mutual Coupling:

Secondary 1 to Primary (≈0)

Secondary 2 to Primary (≈0)

Figure 16:
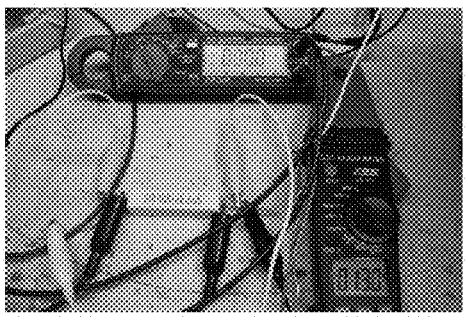

In accordance with the foregoing, the diversion of secondary induced flux away from the primary changes the primary coil power factor is avoided. Lowering of the primary coil's impedance as flux couples back to the primary coil is also avoided. However, as current increases in use, the power factor follows the load and is drawn back to its conventional level, wherein the power factor suffers as the load is increased. However, as shown in FIG. 16 the present invention remedies this problem by creating a 90 degree secondary current delay (electrodynamic delay) in which the secondary current waits until the primary current has peaked IE maximum amplitude TDC "of the flux" ('top dead center' or 'TDC') discharging flux.

A small amount of the flux goes back to primary, however in accordance with the invention it starts a short instant of time delta t later such that, rather than decreasing, it is increasing primary impedance which reverses the advance of the power factor. The present inventor proposes that, in accomplishment of this second major aspect of the invention, is that one or more of the BITT coils acts as a transmission line, similar to a parallel-wire transmission line (such as common household antenna wire) in which the adjacent (primarily, though second-order coupling is possible) turns of the coil provide a spatially-distributed capacitance, acting along the length of the turns. Transmissions lines are distinguished from wires in that the latter conducts charge only along a single dimension s, measured along the wire. (though the wire itself may be laid out in 2- or 3-dimensional space) By comparison, a transmission line stores electrostatic energy between the wires and magnetic energy along the wires, hence it conducts a propagating wave.

The "transmission line" process as described above applies to the present invention when the fine (gauge) wire is selected, which may be bifilar windings, providing a resistance along the wire. Otherwise, the entire transmission of current through the coil would be predominated, as is normally to be expected, by the current flowing along the wire. However, when these electrodynamic coupling effects come into play, it is possible by properly selecting the frequency of operation, such that electrostatic energy storage (occurring along the coupled turns) supplements the simple conduction process. As such, a wave develops, having time-domain characteristics which superimpose, on the wave of current traveling inside the coil wire. Consequently the combination of wire-current wave and time-delayed electrodynamic reflection conspire to create the effect of a phase-shifted current, for all intents and purposes acting as though it were started after the expected time. In a sense the advancing wave collides 'super-elastically'. with a reflection, the net result being that its phase advances and the power factor appears to go negative. Of course the initial current wave crest is excepted from this process, not having had a predecessor to create the reflection. Subsequently however, every wave is 'boosted' by a reflection having altered phase, created or modified by a previous wave. This plausible explanation could be supplemented by considering reflections generated by waves other than the immediately previous wave, and/or having a related but not identical frequency. This process is also described in copending application directed to electrodynamic generator improvements, (ReGenX coil) based on prior document U.S. application Ser. No. 14/059,775. The process utilizes specially wound wire coil configurations to store potential energy internally and electrostatically inside the coil as voltage rather than externally in the electromagnetic field.

The effect of adding resistance to a transmission line is described by Heaviside's Transmission Line & Telegrapher Equations. In accordance with some aspects of the present invention it is proposed that the velocity of the wave process of energy storage traveling along the coil is modified through an increased resistance R along the coil wires. The lossless transmission line velocity for a system otherwise like the present invention is given, as is known, by $v=1/V(LC)$ and the characteristic impedance is $Z_0=V(L/C)$ where L is some coil inductance and C is some characteristic capacitance arising between turns, not necessarily only adjacent ones.

The following schematic shows a very common equivalent circuit for a lossy transmission line, as is found for example in wikipedia:

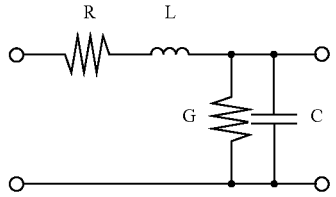

The actual lossy line velocity v is proposed to be related to (R+jωL) and (G+jωC) since it is known from Heaviside's equations that the characteristic impedance of a lossless transmission line generalizes to the loss less case in this way. I.e the characteristic impedance of a lossy transmission line is given by √[(R+jωL)/(G+jωC)] where L & C are as before and G is some measured conductance between turns. The conductance G is not modified in accordance with the present invention. Hence, in the lossy velocity, likely reduced because of R, is likely that the wave will be slowed down overall by the resistance in the coil wires.

An equation of this nature is given in Eric Bogatin's Prentice-Hall publication "Signal Integrity: Simplified."

Eric Bogatin Equation 9-45

$$v = \frac{\omega}{\sqrt{\frac{1}{2}\left[\sqrt{(R_L^2+\omega^2L_L^2)(G_L^2+\omega^2C_L^2)}+\omega^2L_LC_L-R_LG_L\right]}}$$

The subscript "L" simply refers to the fact that these quantities apply to the lossy case. Otherwise they follow equivalent circuit given above. It seems fairly likely, from an analysis of the present invention in the light of this equation, (discarding terms with $G_L$ dependence on the basis that this quantity will always be near zero) that the effect of increasing R will be to reduce the signal velocity. Especially in the case where $R_L$ is made significantly larger than $\omega L_L$, the first remaining term in the inner square root will predominate. It is also clear that increasing R too much, namely in such a way as to invalidate the assumption $G_L$~0 will begin to contribute a reverse effect, on account of the negative sign in the last term in the outer root in the denominator.

A further possibility is that the reverse effect actually predominates, as the $R_LG_L$ product is made large. Since this will lead to a reduction in the denominator, the velocity will increase because of, the fine winding and consequent proximity of coil turns of the transformer suggest that the quantity $C_L$ may be large in the context of the present invention, thus accentuating the $R_L$ contribution (with respect to $G_L$) of the inner denominator root and lending further support to the utility of the structure of the present invention.

The gist of this aspect of the present invention involves affecting the timing of propagation in a beneficial way with respect to the wave phase timing as explained elsewhere in this document. The inventor proposes that altering the speed of the propagating electrodynamic wave allows it to be synchronized with energy storage processes otherwise taking place in the transformer. Whether this beneficial effect arises through reduction, or on the other hand increase, of the propagation velocity is secondary It must be stressed that the usual discussions of lossy transmission line equations concerns transmission of information. In such a context it is generally known that serial resistive losses do not affect the speed of propagation particularly and it is also known that losses may render the characteristics somewhat dispersive, i.e. frequency-dependent. However, in the context of the present invention dispersion is not of particular significance and, on the other hand, the resistance proposed is of a nature and value that does not normally occur in information systems but is suggested to be important here.

It is the conventional coil's induced resistive electromagnetic field that manifests itself between the primary and the secondaries. In order to properly work in accordance with the present invention, the secondaries have to have the same delay properties as the ReGen-X coil to work properly and the operational frequency must be higher than usual in accordance with the observations described in the present document and said prior application. Thus the on-load power factor is zero (or very near zero) in both cases and the BiTT acts as a transformer that delivers actual real power to a load while consuming borrowed reactive power and extremely little real power.

Figure 18:
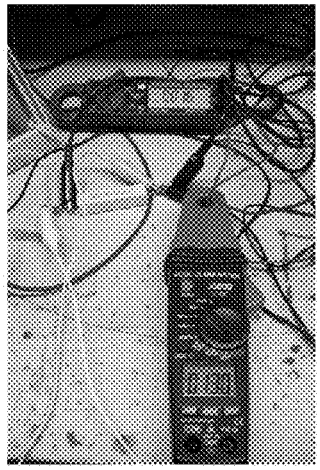
Figure 19:
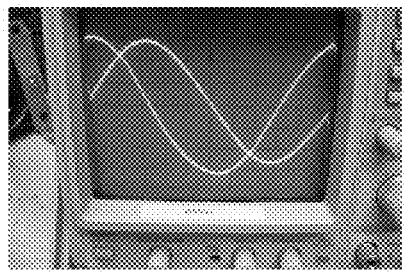

As shown in FIG. 18, the efficiency of the transformer is highly dependent on the precise adjustment of the coupling coefficient, power factor or VAR which may be achieved by adjusting the respective phases of the various relevant processes, as described in the present document, occurring in the cores and also between the turns of the coil windings.

As shown in FIG. 18*e*, the losses in the core, associated with different levels of output power and hence the efficiency of the transformer are critically dependent on the coupling coefficient which may be achieved. In accordance with the present invention, electrodynamic refinements of the coil winding combined with changes to the topology of the transformer magnetic circuit both as described herein, lead to near-perfect achievement of an ideal coupling of zero-phase and hence nearly exclusive use of reactive power to produce real power, in accordance with a long-felt need.

FIG. 17 shows a conventional 3-phase transformer off load 1700, Primary Coil (Off Load) 1701, Secondary Coil #1(Off Load) 1702 and Secondary Coil #2 (Off Load) 1703.

Figure 23:
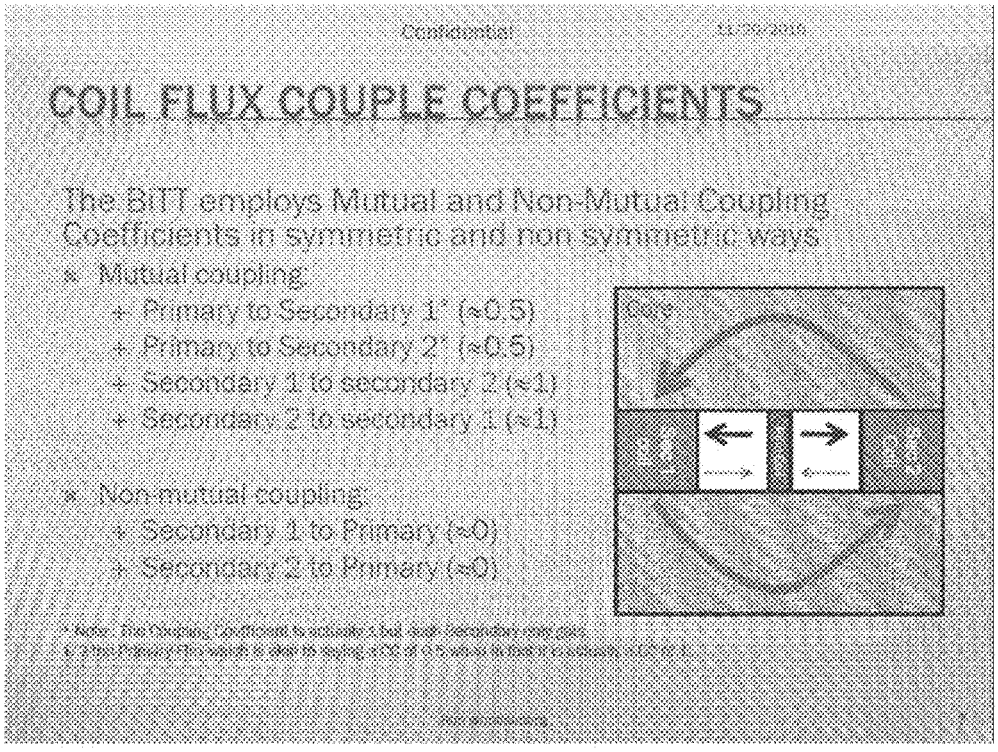
Figure 24:
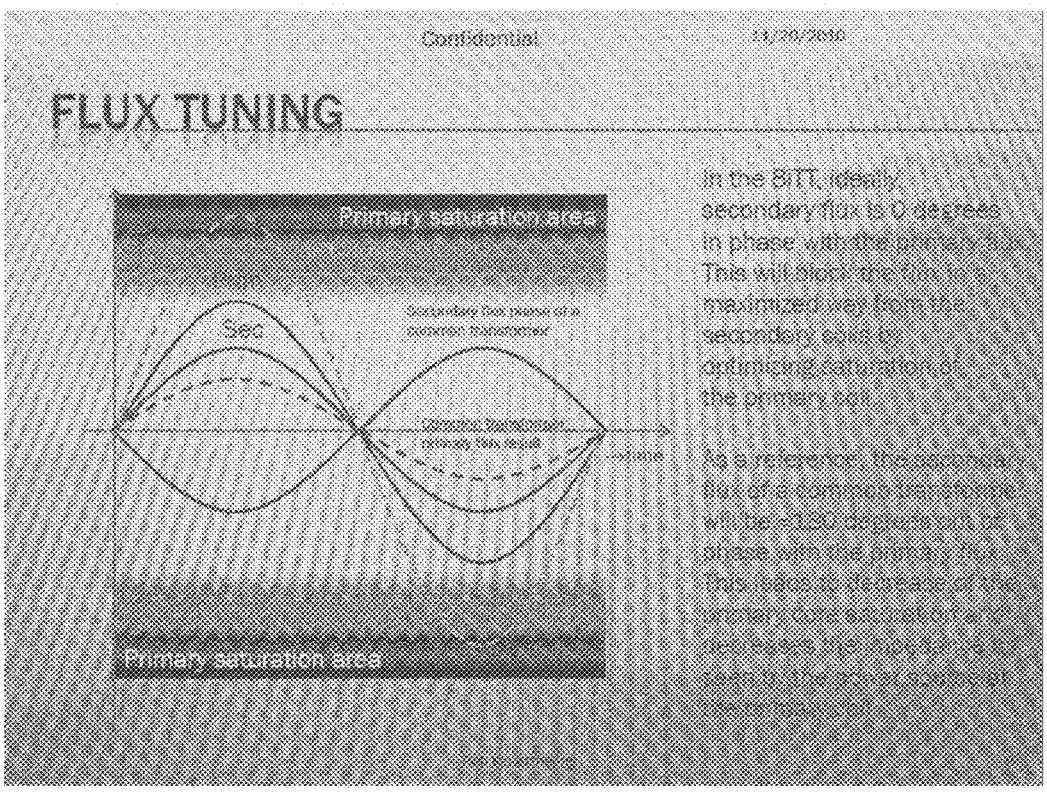

As explained below, in accordance with the present invention the BITT, when properly tuned, behaves as illustrated in FIG. 23 in which the induced flux predominates below the critical minimum frequency $\omega_c$ resulting in a single sinusoidal wave in the equivalent circuit. Above $\omega_c$, the coil produces an AC pulse an AC pulse at or after TDC, the primary current sine wave crest.

Attached artifact A, a computer simulation also showed a negative power factor of less than 0—which the actual BiTT also showed in real bench tests as well.

The Bi-Toroid Transformer (BiTT) operates as a Magnetic Diode, consumes almost pure reactive power but delivers real power to the loads and only allows the transfer of energy in one direction. Because the BiTT primary is isolated from the secondary on-load induced flux, the BiTT primary power factor and current do not change from no-load to on-load. With a purely resistive load on the BiTT the primary power factor is virtually zero and the efficiency of the energy transfer is increased accordingly. If for example, the transformer primary power factor is reduced by 30% the transformer efficiency is also increased by 30%. As well as the applications mentioned above, this transformer can also be applied in chargers and in electric vehicles between the generator and the batteries and between the batteries and the motor.

Since there is no such thing as an ideal coil of wire, all transformer primary coils will have some DC resistance and heat and power losses when operated on no-load even if the Power Factor is zero. When a transformer is placed on-load and load current flows from the secondary coil to the load, a magnetic field is induced around the secondary coil according to Lenz's Law. This on-load secondary coil's induced BEMF magnetic field couples back through the transformer's ferromagnetic core and enters the primary coil's core where it reduces the NET flux in the as registered by the primary coil. This NET flux reduction should not be confused with "flux cancellation" since one magnetic flux cannot cancel another magnetic flux. The NET flux reduction effect is due to a reduction in the NET flux integral of magnetic field flux over the cross-sectional area of the primary coil's core.

When the secondary coil's on-load BEMF induced flux enters the primary core the absolute value of the NET flux increases but the NET flux differential as seen by the primary coil is reduced according to Faraday's Law of Induction. This NET flux differential reduction causes the primary coil's impedance to drop which in turn causes the primary coil to allow an increase of current to flow in the coil. This increase in current flow increases the induced magnetic field produced by the primary coil which in turn, increases the flux delivered to the secondary coil which is a critical component in transformer operation. If the secondary coil's core flux magnitude didn't increase on-load the as described in the chain of events above the secondary coil's voltage would collapse on-load and no power would be delivered to the load.

Lenz's Law and the production of a Back EMF induced magnetic field is a critically important factor in the operation of a transformer but it comes at a cost of increased heat and significant energy efficiency losses in the transformer primary and even transformer failure and fires if they are not controlled properly. The Bi-Toroid Transformer (BiTT) being presented here relieves the burden off of the transformer primary as the sole on-load magnetic flux input source and allows two secondary coils and an alternate flux path route to do the work required of increasing the secondary core flux on load flux magnitude instead.

If one can redirect all or even a percentage of secondary on-load BEMF induced flux away from the primary coil and use said redirected flux to do the same required work in an adjacent secondary coil and vice versa then one can create an more efficient transformer design according to the magnitude of flux diversion. The Bi-Toroid Transformer does just that and when combined with a 45-90 degree load current delay the normal transformer on-load operational paradigm can even be reversed slightly where the secondary BEMF induced flux actually causes the primary impedance to increase on-load and for the BiTT to deliver on-load power with a decrease in current magnitude from the no-load starting point.

Those experienced in the field of this invention should, based on the detailed descriptions of the objectives and new methods, be able to understand the logical possible vatiations. They will be able to adopt appropriate strategies, dimensions and geometries depending on the various applications and needs of different engines, not specifically shown in this application, but within the general goals and objectives of this invention.

The invention claimed is:

1. A transformer comprising a primary and a secondary coil wherein the secondary coil provides an outer secondary flux path route which isolates the primary coil from secondary coil BEMF induced flux, further comprising a secondary coil current delay wherein the induced flux predominates below a critical minimum frequency $\omega_c$ resulting in a single sinusoidal wave in the equivalent circuit and wherein further, above $\omega_c$, the coil produces an AC pulse at the primary current sine wave crest TDC wherein the value of $\omega_e$ is achieved through tuning, wherein said delay further comprises a 90 degree secondary current delay in which the secondary current waits until the primary current has peaked at TDC "of the flux" ('top dead center' or 'TDC') discharging flux.

2. The transformer of claim 1 wherein the secondary coils each provide the required on load flux magnitude increase needed to deliver sustained power to the load.

3. The transformer of claim 1 further comprising a split secondary coil wherein secondary induced flux is isolated from the primary core and wherein magnetic flux passing through the primary and secondary coils are different.

4. The transformer of claim 2 wherein the primary coil is placed on a central leg and two secondaries coils are wound around two side legs.

5. The transformer of claim 4 wherein the secondary coils are magnetically connected to the primary with a coupling coefficient on no load of substantially 1 but isolated from the primary on load with a coupling coefficient of substantially 0.

6. The transformer of claim 2 wherein the primary is evenly distributed between the two secondary coils and no-load voltages are induced in each secondary coil.

7. The transformer of claim 1 wherein the BiTT consumes mostly reactive power in the primary while delivering real power to the loads.

8. The transformer of claim 4 wherein a ring-shaped toroidal core provides the alternate flux path joining the two secondaries.

9. The transformer of claim 1 wherein Mutual and Non-Mutual Coupling Coefficients are both symmetric and non-symmetric.

10. The transformer of claim 9 wherein Mutual coupling of Primary to Secondary 1 is approximately ~0.5, Primary to Secondary 2 is approximately ~0.5, Secondary 1 to secondary 2 is approximately 1 and Secondary 2 to secondary is approximately 1; and wherein further Non-mutual coupling of Secondary 1 to Primary is approximately 0 and of Secondary 2 to Primary is approximately 0.

11. The transformer of claim 1 wherein said delay is brought about by electrodynamic means.

12. The transformer of claim 11 wherein said electrodynamic means comprise a wire-current wave electrostatically storing energy in the space between adjacent coil turns.

13. The transformer of claim 12 wherein said space further comprises dielectric material.

14. The transformer of claim 13 wherein said dielectric material further comprises wire insulation.

15. The transformer of claim 11 wherein said delay produces a constructively-interfering phase-shifted current between adjacent coil turns.

* * * * *